US008251449B2

(12) United States Patent
Wu

(10) Patent No.: US 8,251,449 B2
(45) Date of Patent: Aug. 28, 2012

(54) MULTI-SECTION ANGLE ADJUSTING STRUCTURE FOR A CHAIR BACK

(76) Inventor: Yao-Chuan Wu, Chiayi Hsien (TW)

( * ) Notice: Subject to any disclaimer, the term of this patent is extended or adjusted under 35 U.S.C. 154(b) by 277 days.

(21) Appl. No.: 12/767,195

(22) Filed: Apr. 26, 2010

(65) Prior Publication Data

US 2011/0260517 A1 Oct. 27, 2011

(51) Int. Cl.
*A47C 1/024* (2006.01)

(52) U.S. Cl. ..... 297/301.4; 297/301.5; 297/303.4; 297/362.12; 297/364

(58) Field of Classification Search ..... 297/301.4, 297/301.5, 303.1, 303.4, 362.12, 364
See application file for complete search history.

(56) References Cited

U.S. PATENT DOCUMENTS 712,495 A * 11/1902 Chichester ..... 297/301.4
1,927,491 A * 9/1933 Gabb ..... 297/358
3,351,379 A * 11/1967 Street ..... 297/358
4,579,386 A * 4/1986 Rupp et al. ..... 297/362.12
4,695,093 A * 9/1987 Suhr et al. ..... 297/303.4
5,344,215 A * 9/1994 Dahlbacka ..... 297/375
5,511,852 A * 4/1996 Kusiak et al. ..... 297/301.4
5,984,412 A * 11/1999 Magyar ..... 297/362.12
8,113,586 B2 * 2/2012 Chen ..... 297/303.5

* cited by examiner

*Primary Examiner* — Laurie Cranmer
(74) *Attorney, Agent, or Firm* — Alan Kamrath; Kamrath IP Lawfirm, PA

(57) ABSTRACT

A multi-section angle adjusting structure for a chair back contains a supporting member axially connected to a base and axially inserted to a sliding groove through a shaft to slide in the sliding groove so that the chair back fixed to the supporting member is adjusted to a desired angle relative to the base. The shaft includes a slidable bar fitted thereon to be connected to a slot of the base. Another end of the slot pushes a toothed block biased against by a first spring which contacts with a stop plate so that the toothed block abuts against an end portion of the slidable bar. The slot includes a positioning structure mounted therein, and the positioning structure includes a toothed seat guided by a guiding line to engage with the toothed block.

1 Claim, 5 Drawing Sheets

MULTI-SECTION ANGLE ADJUSTING STRUCTURE FOR A CHAIR BACK

BACKGROUND OF THE INVENTION

1. Field of the Invention

The present invention relates to a multi-section angle adjusting structure for a chair back having a plurality of engagable positions which can be selected to micro-adjust the desired angle of the chair back, obtaining an ergonomic and angle-adjustable purpose.

2. Description of the Prior Art

A conventional angle adjusting structure for a chair back includes a supporting member to support the chair back, and a shaft inserted to a sliding groove of a base to slide. Thus, the supporting member swings relative to the base, and the shaft includes a slidable bar fitted thereon to control a positioning element to adjust the chair back to a desired angle.

However, the positioning element is assembled inconveniently, because it is comprised of at least two parts to cause high production cost and a large installing space.

The present invention has arisen to mitigate and/or obviate the afore-described disadvantages.

SUMMARY OF THE INVENTION

The primary objective of the present invention is to provide a multi-section angle adjusting structure for a chair back that can swing the chair back forward and rearward like a rocking chair. After a user adjusts the chair back to a desired angle, an adjustor is used to release a guiding line so that the toothed seat engages with a toothed block to position a supporting member and the chair back.

Another objective of the present invention is to provide a multi-section angle adjusting structure for a chair back having a plurality of engagable positions, and the toothed block engaging with the tooth-shaped surface of the toothed seat can be selected to micro-adjust the desired angle of the chair back, obtaining an ergonomic and angle-adjustable purpose.

To obtain the above objectives, a multi-section angle adjusting structure for a chair back provided by the present invention comprises a supporting member axially connected to a base and axially inserted to a sliding groove through a shaft to slide in the sliding groove. Thus, the chair back fixed to the supporting member is adjusted to a desired angle relative to the base. The shaft includes a slidable bar fitted thereon to be connected to a slot of the base. Another end of the slot pushes a toothed block biased by a first spring which contacts with a stop plate so that the toothed block abuts against an end portion of the slidable bar. The slot includes a positioning structure mounted therein, and the positioning structure includes a toothed seat guided by a guiding line to engage with the toothed block.

In operation, when the toothed seat is pushed by the second spring to engage with the toothed block and since the toothed block is fixed in the slot, the slidable bar of the shaft is positioned with a swing to position the chair back of the supporting member.

When the guiding line is pulled by a user by using the adjustor, the toothed seat slides in the holder to compress the second spring so that the toothed seat disengages from the toothed block. Thereby, the toothed block is not fixed. Thereafter, the first spring in the slot pushes the toothed block and the slidable bar so that the chair back returns to an original position. Alternately, a user can lay on the chair back to actuate the slidable bar to push the toothed block so that the first spring is compressed by the toothed block. Hence, the chair back is adjusted to the desired angle by the user. Thereafter, the guide line of the adjustor is released so that the toothed seat is pressed by the second spring. Then, the tooth-shaped surface of the toothed seat engages with the toothed block, such that the supporting member is positioned without sliding (because the toothed block limits the slidable bar, the shaft is positioned in the sliding groove).

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
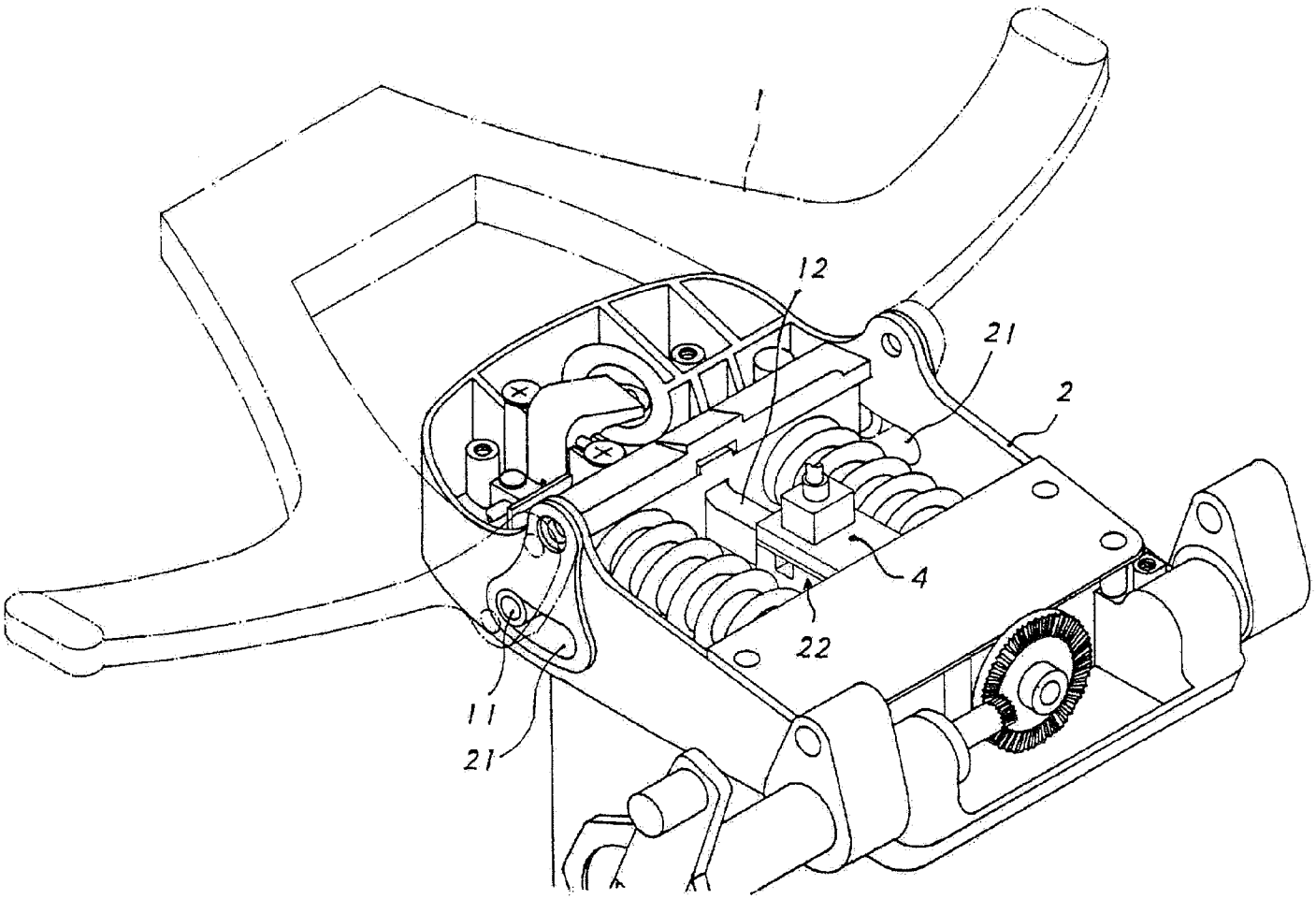
FIG. 1 is a perspective view showing the assembly of a multi-section angle adjusting structure for a chair back according to a preferred embodiment of the present invention.
Figure 2:
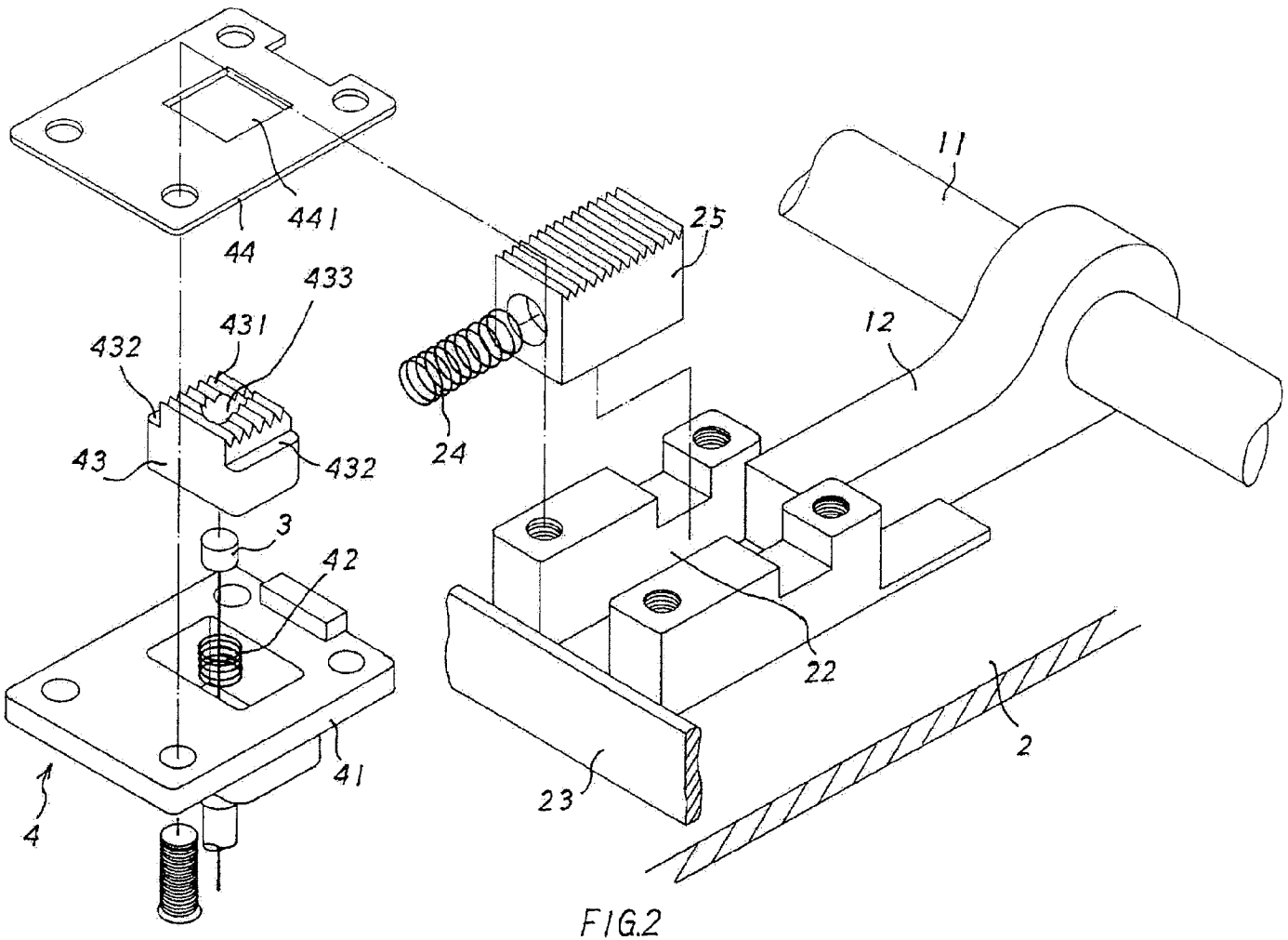
FIG. 2 is a perspective view showing the exploded components of the multi-section angle adjusting structure for the chair back according to the preferred embodiment of the present invention.

A multi-section angle adjusting structure for a chair back in accordance with a preferred embodiment of the present invention includes a supporting member 1 axially connected to a base 2 (as shown in FIG. 1) and axially inserted to a sliding groove 21 through a shaft 11 to slide in the sliding groove 21 so that the chair back fixed to the supporting member 1 is adjusted to a desired angle relative to the base 2. The shaft 11 includes a slidable bar 12 fitted thereon to be connected to a slot 22 of the base 2. Another end of the slot 22 pushes a toothed block 25 biased by a first spring 24 which contacts with a stop plate 23 so that the toothed block 25 abuts against an end portion of the slidable bar 12 (as illustrated in FIG. 2). The slot 22 includes a positioning structure 4 mounted therein, and the positioning structure 4 includes a toothed seat 43 guided by a guiding line 3 to engage with the toothed block 25.

The positioning structure 4 is comprised of a holder 41 corresponding to the slot 22, a second spring 42, the toothed seat 43, and a pad 44 covered to the toothed seat 43. A tooth-shaped surface 431 of the toothed seat 43 extends out of a recess 441 of the pad 44. Shoulders 432 of two sides of the toothed seat 43 are biased by the pad 44, and the toothed seat 43 includes a trough 433 formed thereon.

Figure 3:
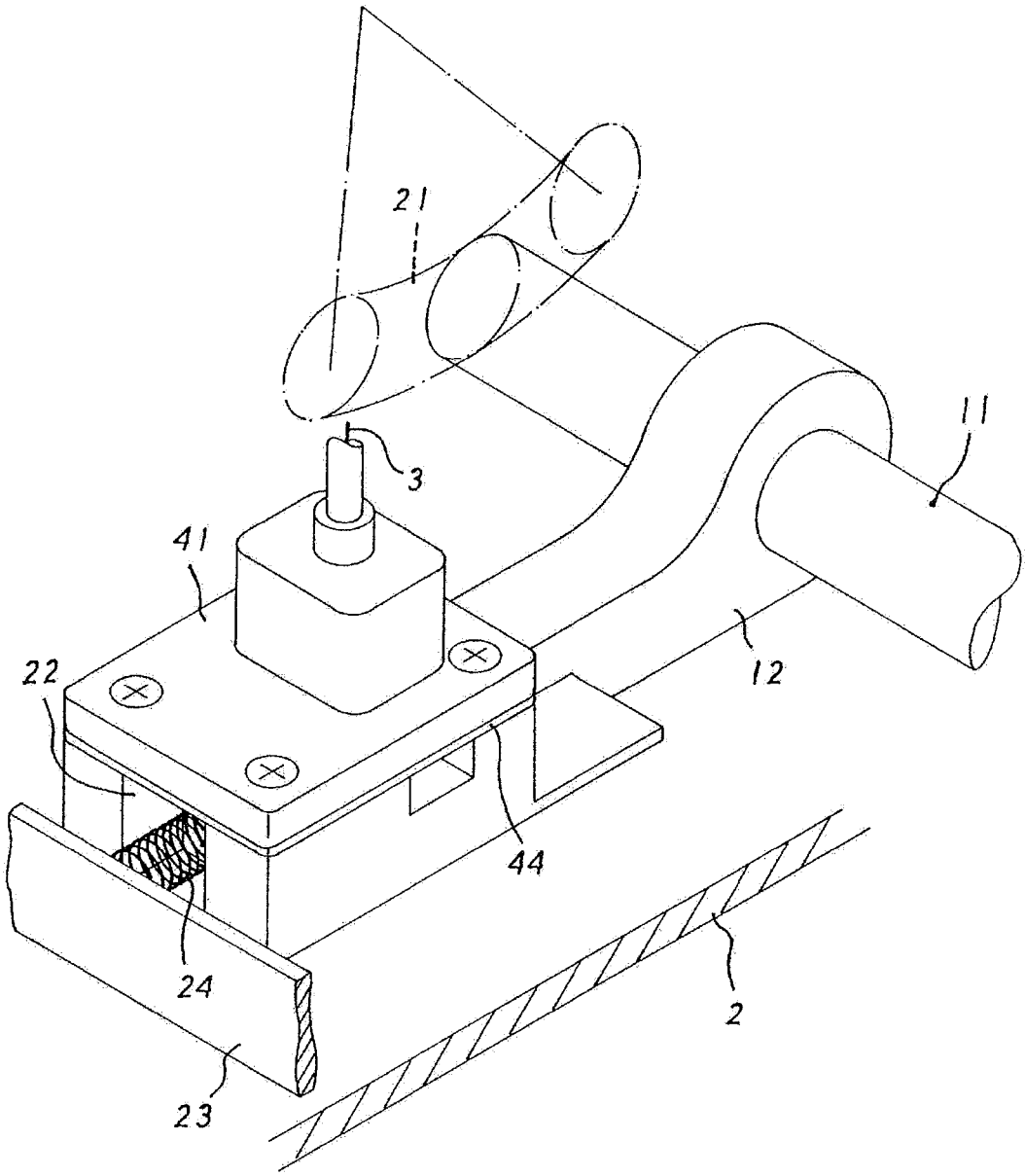
FIG. 3 is another perspective view showing the assembly of the multi-section angle adjusting structure for the chair back according to the preferred embodiment of the present invention.

In assembly, the guiding line 3 is received to the trough 433 of the toothed seat 43 and then inserted to the second spring 42 and the holder 41 to be guided by an adjustor (as shown in FIG. 3), such that the positioning structure 4 is locked to the slot 22. Hence, the tooth-shaped surface 431 of the toothed seat 43 is pushed by the second spring 42 to extend out of the recess 441 to engage with the toothed block 25, thus finishing assembly.

Figure 4:
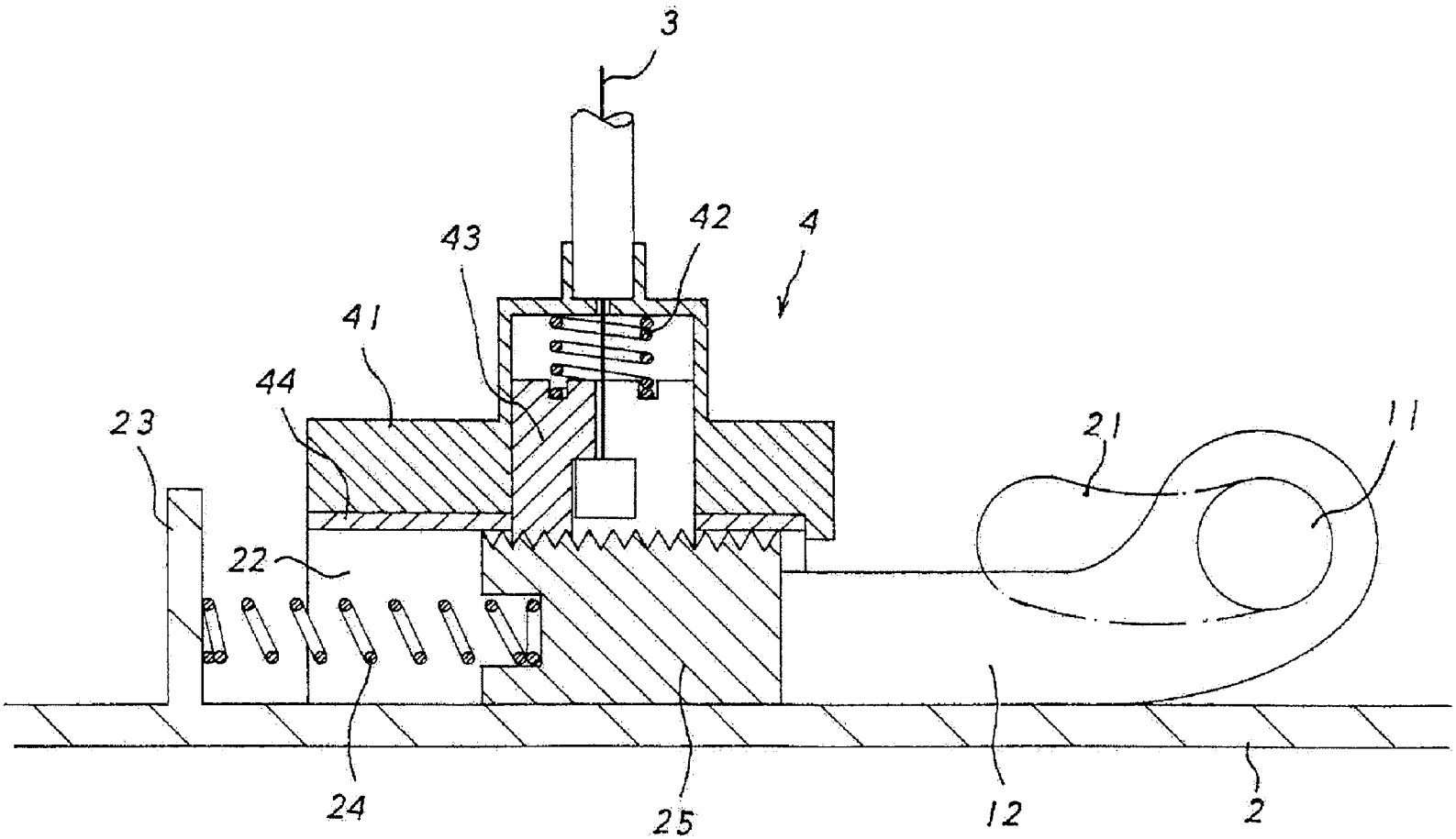
FIG. 4 is a cross sectional view showing the operation of the multi-section angle adjusting structure for the chair back according to the preferred embodiment of the present invention.

In operation, when the toothed seat 43 is pushed by the second spring 42 to engage with the toothed block 25 (as illustrated in FIG. 4) and since the toothed block 25 is fixed in the slot 22, the slidable bar 12 of the shaft 11 is positioned without a swing to position the chair back on the supporting member 1.

Figure 5:
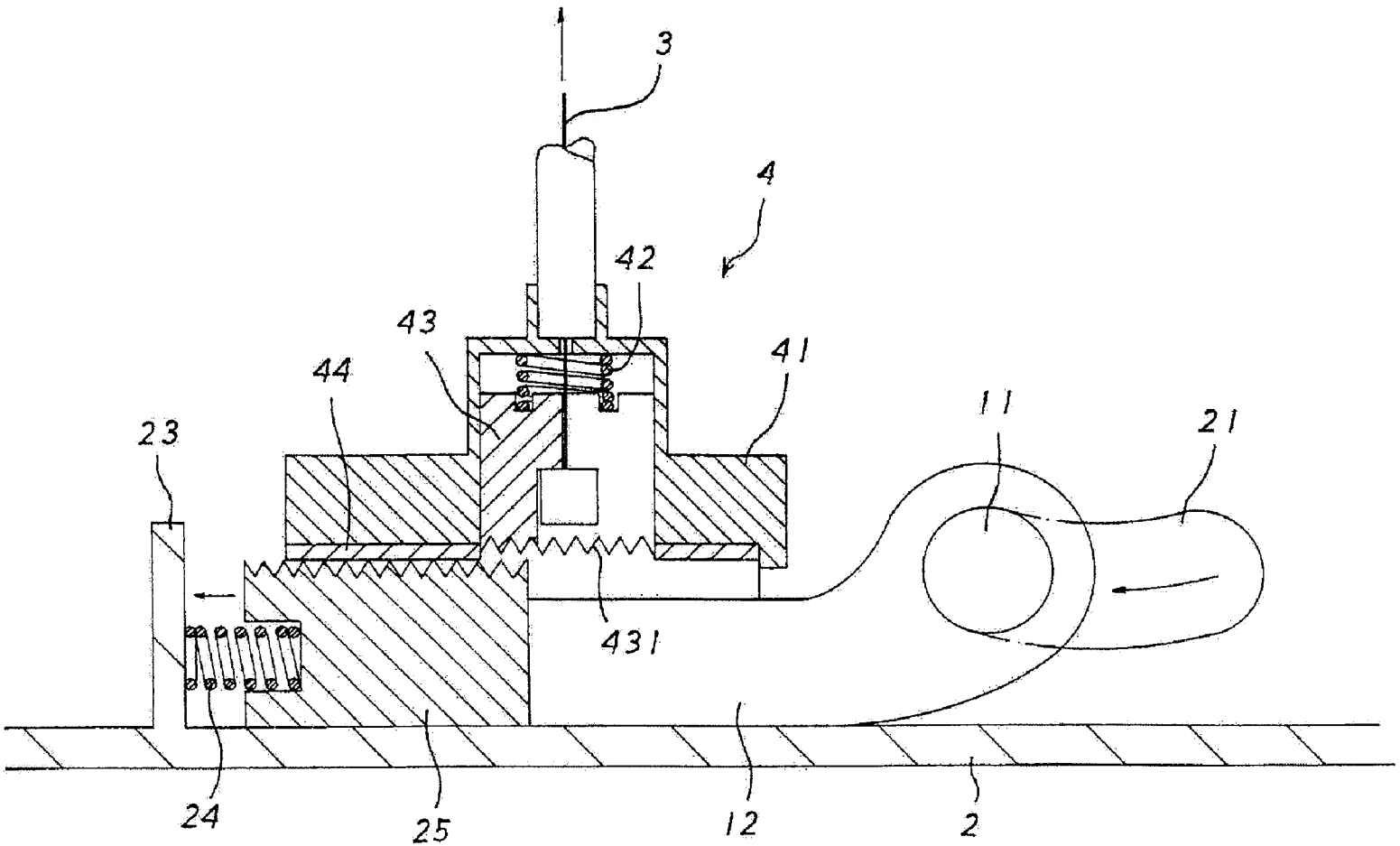
FIG. 5 is another cross sectional view showing the operation of the multi-section angle adjusting structure for the chair back according to the preferred embodiment of the present invention.

When the guiding line 3 is pulled by a user by using the adjustor, the toothed seat 43 slides in the holder 41 to compress the second spring 42 so that the toothed seat 43 disengages from the toothed block 25, and the toothed block 25 is not fixed. Thereafter, the first spring 24 in the slot 22 pushes the toothed block 25 and the slidable bar 12 so that the chair back returns to an original position, or a user can lay on the chair back to actuate the slidable bar 12 to push the toothed block 25 so that the first spring 24 is compressed by the toothed block 25 (as shown in FIG. 5. Hence, the chair back is adjusted to the desired angle by the user. Thereafter, the guide line 3 of the adjustor is released so that the toothed seat 43 is pressed by the second spring 42. Then, the tooth-shaped surface 431 of the toothed seat 43 engages with the toothed block 25, such that the supporting member 1 is positioned without sliding (because the toothed block 25 limits the slidable bar 12, the shaft 11 is positioned in the sliding groove 21).

Furthermore, since the toothed block 25 engages with the tooth-shaped surface 431 of the toothed seat 43, a plurality of engagable positions can be selected to micro-adjust the desired angle of the chair back, obtaining an ergonomic and angle-adjustable purpose.

While various embodiments in accordance with the present invention have been shown and described, it is clear to those skilled in the art that further embodiments may be made without departing from the scope of the present invention.

What is claimed is:

1. A multi-section angle adjusting structure for the chair back comprising:

a supporting member axially connected to a base and axially inserted to a sliding groove through a shaft to slide in the sliding groove, wherein the chair back fixed to the supporting member is adjusted to a desired angle relative to the base, wherein the shaft includes a slidable bar fitted thereon to be connected to a slot of the base, wherein an end of the slot pushes a toothed block biased by a first spring which contacts with a stop plate, wherein the toothed block abuts against an end portion of the slidable bar, wherein the slot includes a positioning structure mounted therein, wherein the positioning structure includes a toothed seat guided by a guiding line to engage with the toothed block, wherein the positioning structure comprises a holder corresponding to the slot, a second spring, the toothed seat, and a pad covered to the toothed seat, wherein a tooth-shaped surface of the toothed seat extends out of a recess of the pad, wherein shoulders of two sides of the toothed seat are biased by the pad, and wherein the toothed seat includes a trough to receive the guiding line inserted through the second spring and the holder to be guided.

* * * * *